US005735391A

United States Patent [19]

Harrell et al.

[11] Patent Number: 5,735,391

[45] Date of Patent: Apr. 7, 1998

[54] DUAL SLIDE THREE-POSITION SWITCH

[75] Inventors: Richard Harrell, Taylor; George B. Wolfe, Plymouth, both of Mich.

[73] Assignee: United Technologies Automotive, Inc., Dearborn, Mich.

[21] Appl. No.: 771,292

[22] Filed: Dec. 20, 1996

[51] Int. Cl.[6] ..... H01H 15/06

[52] U.S. Cl. ..... 200/549; 200/547; 200/5 R; 200/16 R

[58] Field of Search ..... 200/549, 547, 200/16 R, 16 C, 16 D, 557, 5 R

[56] References Cited

U.S. PATENT DOCUMENTS

| | | | |
|---|---|---|---|
| 4,425,487 | 1/1984 | Hsieh | 200/557 |
| 4,918,264 | 4/1990 | Yamamoto et al. | 200/557 |
| 5,622,254 | 4/1997 | Lee | 200/557 |

*Primary Examiner*—David J. Walczak
*Attorney, Agent, or Firm*—Howard & Howard

[57] ABSTRACT

An improved switch includes two moving contact members which move in parallel planes. The switch may be moved to either of two positions to complete either of two circuits. The contact members are normally biased to a central neutral position. Since the contact members move in a plane, rather than pivoting on a yoke, there is greater tolerance in positioning the moving contact members.

17 Claims, 2 Drawing Sheets

DUAL SLIDE THREE-POSITION SWITCH

BACKGROUND OF THE INVENTION

This invention relates to a switch that moves between three positions to complete two distinct circuits, wherein the moving contact members move linearly.

A known three-position switch is utilized to provide switch actuation for two distinct circuits, along with a "home" or neutral position. This type of switch is widely utilized in applications for controlling movement of an element in opposed directions. As one common example, a switch for moving a seat rearwardly or forwardly typically has a central neutral position at which the seat does not move. The switch can be actuated in one direction to move the seat forward, and in the opposite direction to move the seat rearwardly.

Typically, the known three position switches rely upon a rocking yoke carrying a pair of contacts. The rocking yoke is typically biased to a central neutral position at which the contacts are maintained out of contact with corresponding contact plates. An operator may move the rocking yoke against the bias force to either of two extreme positions at which the contacts do contact a contact plate, completing a circuit. In this way, the operator can control the movement of an element, such as a seat.

The yoke switch does have certain deficiencies. In particular, the height of the yoke and contacts relative to the contact plates must be carefully controlled. If the heights are not carefully controlled, then the contacts may not make good contact with the contact plates. This presents challenges to the designer and assembler of the switches.

SUMMARY OF THE INVENTION

In a disclosed embodiment of this invention, a switch moves between positions for completing two distinct circuits, and to a central neutral position. Moving contact members move linearly, and in a parallel plane between the two "actuation" positions. In a preferred embodiment of this invention, opposed contact plates are defined at two ends of the switch housing. When the contact plates are contacted by a moving switch contact, one of two circuits is completed.

This type of switch may be preferably utilized for controlling a moving element such as a seat. When one of the two circuits is complete, the seat is moved forwardly, and when the other is complete, the seat is moved rearwardly. The switch is biased to the neutral position at which the seat is not moved.

In a preferred embodiment of this invention, the switch is grounded when in the neutral position. The housing preferably includes ground plates at locations spaced from each other by a first axial distance. The housing further includes actuation contact plates for each of the two circuits which are spaced beyond the ground plates.

A central actuation post can move either of the moving contact members to complete either of the two circuits. Springs bias the two moving contact members to the central neutral position. The moving actuation post may overcome the spring force and move one of the two moving contact members to complete its respective circuit.

In preferred embodiments of this invention, the moving contact members have opposed interfitting fingers and slots. Each of the contact members has one finger received between slots on the other component. The slots are on a side of the contact members adjacent the actuation contact plate for the other contact member. A spring is preferably mounted between each finger and the post. The opposed springs bias the two contact members to the neutral position.

The actuation post may move either contact member to complete its circuit. Arms from the post are guided in guide slots in both contact members, thus ensuring linear parallel movement of the contact members.

In one main feature of this invention, the contacts which move with the moving contact members are formed in a plane which is perpendicular to the direction of movement of the moving contact members. In this way, the contacts are brought into facial contact with a contact plate in the plane. This is an improvement over the prior art pivoting movement, and requires less precise positioning of the contact members than the prior art pivoting or yoke type three-position switch.

These and other features of the present invention will be best understood from the following specification and drawings, of which the following is a brief description.

DETAILED DESCRIPTION OF A PREFERRED EMBODIMENT

Figure 1:
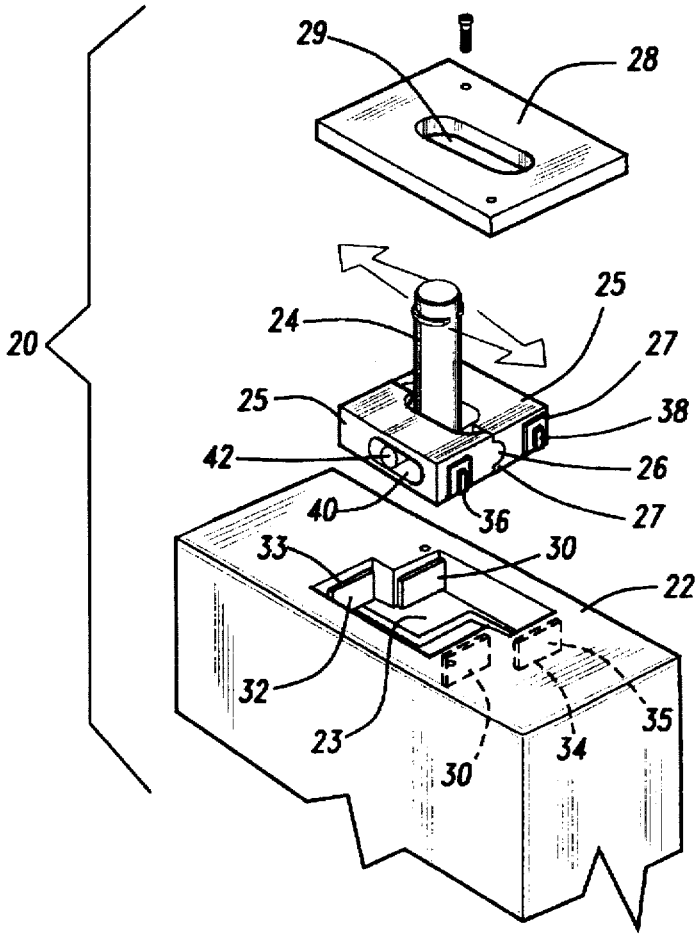
FIG. 1 is an exploded view of a switch according to the present invention.

An improved switch 20 is illustrated in FIG. 1. A switch housing 22 includes guide floor 23 for guiding moving members as will be explained below. An actuation post 24 is received between two relatively moving contact members 25. Each contact member 25 has a finger 26 at one end guided between slots 27 from the other member. The actuation post 24 may receive a cover plate 28 including a slot 29 for allowing the post 24 to pivot.

A pair of ground plates 30 are received within housing 22 and grounded. A first actuation contact plate 32 is shown leading to a wire 33. A first circuit is completed by contact between plate 32 and a contact member 25. Similarly, a second actuation contact plate 34 communicates with a wire 35 to complete a second circuit when contacted by a moving contact member. As shown, moving contact members 25 each include electrical contacts at both axial ends. At one axial end, a ground contact 36 selectively contacts a ground plate 30. An actuation contact 38 selectively contacts one of the actuation contact plates 32 or 34. In the position shown in FIG. 1, only one contact can be seen on each moving contact member 25. It should be understood, that the contact member 25 with the ground contact 36 at the illustrated end in FIG. 1 has an actuation contact 38 at its opposed end. Similarly, the contact member 25 having the illustrated actuation contact 38 has a ground contact 36 at its non-illustrated end.

As shown, the contacts 36 and 38 are formed on ends of the moving contact members 25, and are found in a plane which is perpendicular to the direction of movement of the moving contact members 25. Thus, these contacts are brought into facial contact with the planar contact plates 30, 32, 34. Less precise positioning of the switch components is thus required than was the case with the prior art pivoting yoke-type three position switches.

Figure 2:
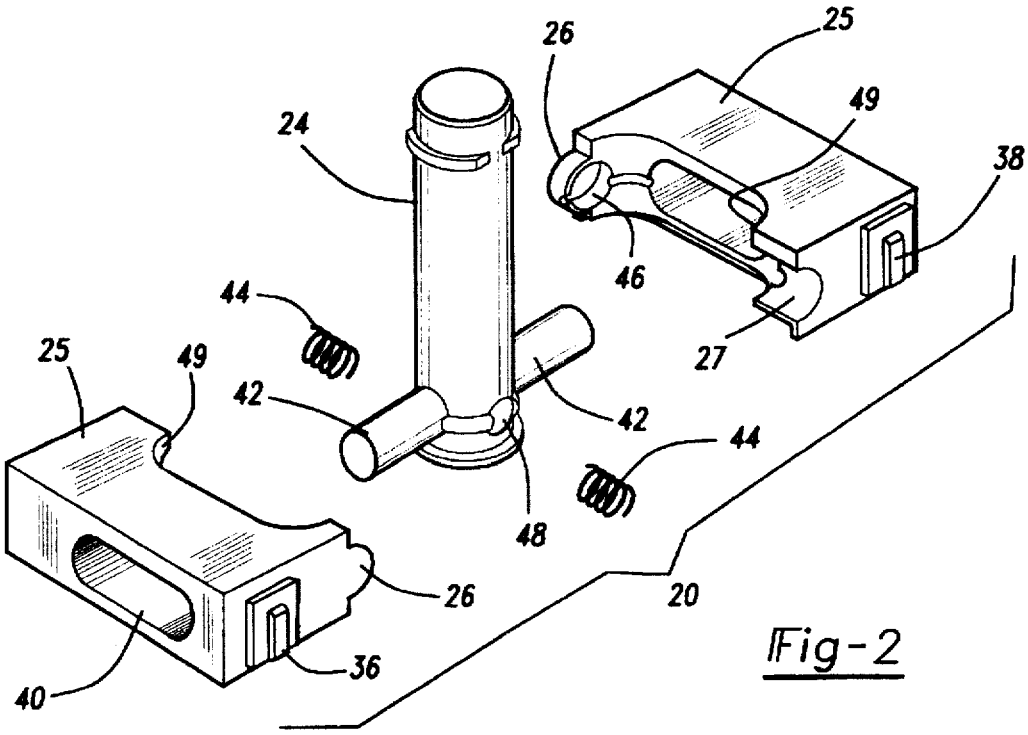
FIG. 2 is an exploded view of the main switch and components.

As shown in FIG. 2, each contact member 25 has a guide slot 40 receiving an arm 42 from the actuation post 24. Arms 42 allow the two contact members 25 to move relative to the post 24, and each other, during actuation of the circuits. As shown, the slots 40 are elongated and extend for a greater distance than the arms 42. Arms 42 can thus move with the guide slots 40, and ensure the movement of the contact members 25 is linear and parallel to a common central plane.

Springs 44 fit into cylindrical spring receiving spaces 46 in each finger 26. Each spring 44 provides a bias force between a cylindrical spring seat 48 in post 24 and the finger 26. Each contact member 25 includes an abutment face 49 that is contacted by knob 24 when it is being driven to actuate its respective circuit.

Figure 3:
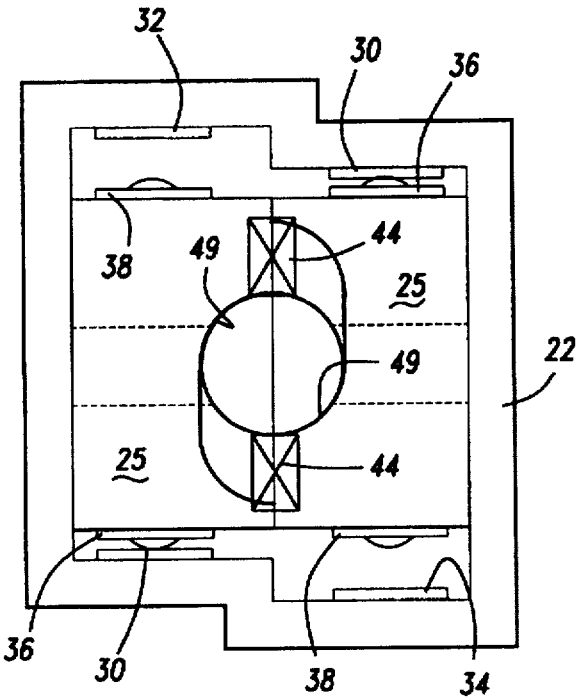
FIG. 3 shows a neutral position of the inventive switch.

As shown in FIG. 3, the switch is in a neutral position. The springs 44 bias fingers 26, and hence contact members 25, into positions at which the ground contacts 36 contact the ground plates 30. As shown, the ground plates 30 are spaced by a first axial distance, while the actuation plates 32 and 34 are spaced outwardly of the ground plates 30. In this position, the abutment faces 49 are both biased against the actuation knob 24. The switch is held at this neutral position unless an actuation force is applied to knob 24.

Figure 4A:
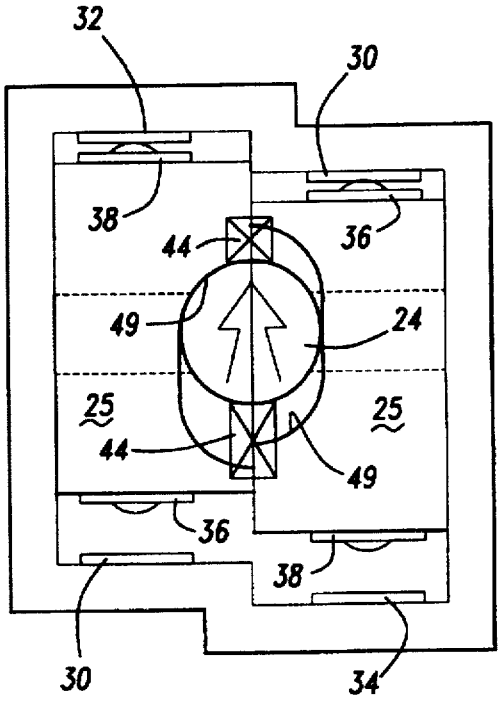
FIG. 4A shows a first actuated position.

As shown in FIG. 4A, the actuation knob 24 has now been driven upwardly as shown in the figure. Knob 24 forces abutment face 49 on the left-most contact member 25 upwardly. Actuation contact 38 now contacts actuation plate 32. A first circuit is now completed. As shown, the spring 44 received on the right-most contact member 25 is compressed. The right contact member 25 is thus held securely, with ground contact 36 held against ground plate 30.

Figure 4B:
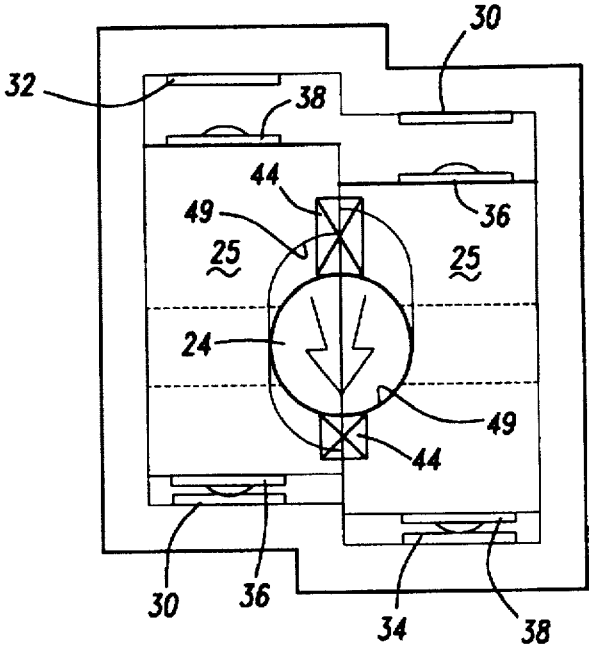
FIG. 4B shows a second actuated position.

The movement is reversed in FIG. 4B. Now, actuation contact 38 is held against actuation plate 34. The second circuit is completed in this position. When the force is released from the actuation knob 24, the contact members return to the position shown in FIG. 3.

Figure 5:
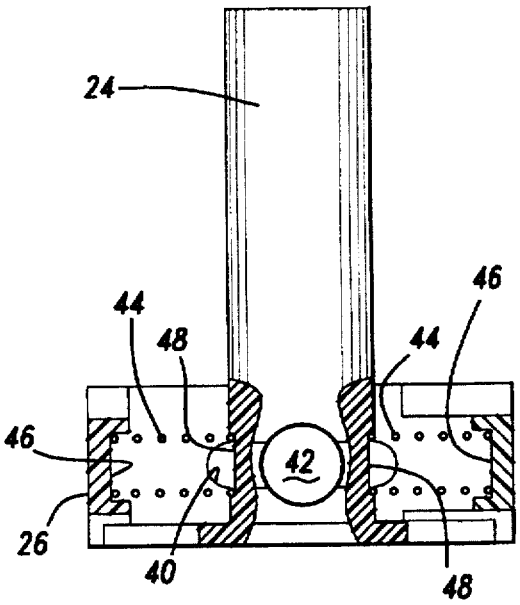
FIG. 5 is a cross-sectional view through a portion of the switch of the present invention.

FIG. 5 is a cross-sectional view along the center line of springs 44 and actuation knob 24. As shown, each finger 26 includes a cylindrical pocket 46. The springs 44 are received between cylindrical pocket 46 and a pocket 48 in actuation knob 24. As shown, arms 42 extend through guide slots 40.

The linear movement of the moving contact member brings the actuation contacts into contact with an actuation plate in a plane which is perpendicular to the linear direction of movement of the moving contact member 25. In this way, the tight tolerances that were set for the known rocker or yoke-type three position switches are no longer necessary. The present invention thus simplifies the assembly of a three-position switch when compared to prior art yoke-type three-position switches.

A preferred embodiment of this invention has been disclosed, however, a worker of ordinary skill in the art would recognize that certain modifications would come within the scope of this invention. For that reason, the following claims should be studied to determine the true scope and content of this invention.

We claim:

1. A three-position switch comprising:

a moving switch body having at least two actuation contacts;

a switch housing having actuation contact plates for being selectively contacted by one of said actuation contacts, said actuation contacts being spaced from respective ones of said contact plates in opposed directions, said moving switch body selectively moving each of said actuation contacts in a plane in opposed axial directions relative to each other to bring one of said actuation contacts into contact with a respective one of said actuation plates, and wherein said actuation contacts complete a circuit when contacting said actuation plates, and said moving switch body being biased to a central neutral position where said actuation contacts are maintained out of contact with said actuation plates.

2. A switch as recited in claim 1, wherein springs bias said moving switch body to said neutral position unless a force is applied to said moving switch body.

3. A switch as recited in claim 2, wherein an actuation knob selectively moves said moving switch body to move one of said actuation contacts into contact with one of said actuation plates.

4. A switch as recited in claim 3, wherein said moving switch body includes two separate contact members, each of said contact members carrying one of said actuation contacts.

5. A switch as recited in claim 4, wherein said switch housing includes two ground plates, each of said contact members also carrying a ground contact, said springs biasing each of said ground contacts into contact with one of said ground plates unless a force is applied to said moving switch body.

6. A switch as recited in claim 5, wherein said ground plates are spaced from each other by a first distance, said actuation plates being positioned beyond said ground plates and spaced by a distance greater than said first axial distance.

7. A switch as recited in claim 5, wherein each of said contact members includes a central finger interfitted between guide slots in the other of said contact members at one axial end, said spring received between said finger and an actuation member to bias said contact members to said neutral position.

8. A three-position switch comprising:

a moving switch body having at least two actuation contacts;

a switch housing having actuation contact plates for being selectively contacted by one of said actuation contacts, said actuation contacts being spaced from respective ones of said contact plates in opposed directions, said moving switch body selectively moving one of said actuation contacts in a plane in opposed axial directions to bring one of said actuation contacts into contact with a respective one of said actuation plates, and wherein said actuation contacts complete a circuit when contacting said actuation plates, and said moving switch body being biased to a central neutral position where said actuation contacts are maintained out of contact with said actuation plates, springs bias said moving switch body to said neutral position unless a force is applied to said moving switch body, an actuation knob selectively moves said moving switch body to move one of said actuation contacts into contact with one of said actuation plates, said moving switch body includes two separate contact members, each of said contact members carrying one of said actuation contacts; and each of said contact members including guide slots extending for an elongated distance, said actuation knob having guide arms received in each of said guide slots, said guide arms extending for a distance that is less than said elongated distance such that said guide arms can move within said guide slots as said actuation knob moves to move said contact members.

9. A switch as recited in claim 1, wherein said actuation contacts are brought into contact in a plane with said actuation contact plates which is perpendicular to said plane of movement of said moving switch body.

10. A three position switch comprising:

a moving switch body comprising two separately moveable contact members, each of said contact members carrying an actuation contact at one axial end and a ground contact at an opposed axial end, said ground contacts on said moving contact members being at opposed axial ends and said actuation contacts on said contact members being at opposed axial ends;

a switch housing having a pair of actuation contact plates, and a pair of ground contact plates, said actuation contact plates being operable to complete an electrical circuit when contacted by one of said actuation contacts from said contact member;

an actuation knob being received at a central location between said contact members; and springs biasing each of said contact members towards each other, and to a position wherein each said ground contact contacts one of said contact plates, each of said contact members being moveable relative to the other of said contact members to bring its associated actuation contact into contact with one of said actuation contact plates to complete an electric circuit.

11. A switch as recited in claim 10, wherein each of said contact members includes a central finger interfitted between guide slots and the other of said contact members, and at one axial end, said spring received between said finger and said actuation knob to bias said contact members to said neutral position.

12. A switch as recited in claim 10, wherein said finger on said contact member is associated with an end of said contact member carrying said ground contact, and said slots are associated with an axial end of said contact member carrying said actuation contact.

13. A switch as recited in claim 12, wherein said actuation contacts are brought into contact in a plane with said actuation contact plate which is perpendicular to a linear direction of movement of said moving contact member.

14. A switch as recited in claim 10, wherein said switch is utilized to control the movement of a moveable seat.

15. A three-position switch comprising:

a moving switch body comprising two separately movable contact members, each of said contact members having end faces defining axial ends of said moving contact members, one of said end faces of each of said contact members carrying an actuation contact, said actuation contacts being at opposed axial ends of said moving contact members;

a switch housing having a pair of actuation contact plates, said actuation contact plates being operable to complete an electrical circuit when contacted by one of said actuation contacts from said contact members, said actuation contacts being spaced from respective ones of said contact plates in opposed directions;

an actuation knob received at a central location between said moving contact members; and springs biasing said contact members towards a neutral position at which said actuation contacts are maintained out of contact with said actuation contact plates, each of said contact members being movable in opposed directions relative to each other along said axial direction to bring its associated actuation contact into contact with one of said actuation contact plates to complete an electrical circuit, and said actuation contact being brought into contact with said actuation contact plate in a plane which is perpendicular to said axial direction.

16. A switch as recited in claim 15, wherein opposed axial directions are spaced by 180°.

17. A switch as recited in claim 1, wherein said opposed axial directions are spaced by 180°.

* * * * *